US007051810B2

(12) United States Patent
Clemens et al.

(10) Patent No.: US 7,051,810 B2
(45) Date of Patent: May 30, 2006

(54) DOWNHOLE FORCE GENERATOR AND METHOD FOR USE OF SAME

(75) Inventors: Jack G. Clemens, Plano, TX (US); Darrell W. Moore, Irving, TX (US); Michael Campbell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 315 days.

(21) Appl. No.: 10/662,797

(22) Filed: Sep. 15, 2003

(65) Prior Publication Data

US 2005/0056427 A1 Mar. 17, 2005

(51) Int. Cl.
*E21B 31/107* (2006.01)

(52) U.S. Cl. ..... 166/301; 166/98; 166/117.6; 166/118; 166/382

(58) Field of Classification Search ..... None
See application file for complete search history.

(56) References Cited

U.S. PATENT DOCUMENTS

| | | | | |
|---|---|---|---|---|
| 4,687,054 | A | 8/1987 | Russell et al. | |
| 5,070,941 | A | 12/1991 | Kilgore | |
| 5,103,903 | A | 4/1992 | Marks, II | |
| 5,139,086 | A | 8/1992 | Griffith, Sr. | |
| 5,197,773 | A | 3/1993 | Vick, Jr. | |
| 5,228,507 | A | 7/1993 | Obrejanu et al. | |
| 5,267,613 | A | 12/1993 | Zwart et al. | |
| 5,330,018 | A | 7/1994 | Griffith | |
| 5,492,173 | A | 2/1996 | Kilgore et al. | |
| 5,775,433 | A | 7/1998 | Hammett et al. | |
| 5,988,287 | A * | 11/1999 | Jordan et al. | 166/386 |
| 6,070,672 | A | 6/2000 | Gazda | |
| 6,199,628 | B1 | 3/2001 | Beck et al. | |
| 6,502,638 | B1 | 1/2003 | Stoesz | |
| 6,729,419 | B1 | 5/2004 | Lee | |

FOREIGN PATENT DOCUMENTS

| | | |
|---|---|---|
| EP | 0 511 789 A2 | 11/1992 |
| EP | 0 931 906 A2 | 7/1999 |
| EP | 0 952 302 A2 | 10/1999 |
| EP | 1 344 893 A2 | 9/2003 |
| EP | 0 999 343 B1 | 4/2004 |
| WO | WO 03/048511 A1 | 6/2003 |
| WO | WO 2004/013457 | 2/2004 |

OTHER PUBLICATIONS

UK Search Report; Jan. 21, 2005; 2 pages.
Dutch Search Report; Apr. 11, 2005; 3 pages.

* cited by examiner

*Primary Examiner*—Zakiya W. Bates
(74) *Attorney, Agent, or Firm*—Lawrence R. Youst

(57) ABSTRACT

A downhole force generator (60) adapted to be moved to a target location within a wellbore (70) for interaction with a well tool (74) previously positioned in the wellbore (70) comprises a downhole power unit (62) having a moveable shaft (68). An anchor (64) is operably associated with the downhole power unit (62). The anchor (64) has an anchoring configuration and a running configuration. In the anchoring configuration, the anchor (64) longitudinally secures the downhole force generator (60) within the wellbore (70). An operating tool (66) is operably associated with the downhole power unit (62) and is operably engageable with the well tool (74) such that when the operating tool (66) is operably engaged with the well tool (74) and the anchor (64) is in the anchoring configuration, movement of the moveable shaft (68) will transmit a force to the well tool (74).

59 Claims, 4 Drawing Sheets

10
12
14
16
18
20
22
24
26
28
30
32
34
36
38
40
42
44
46
48
50

DOWNHOLE FORCE GENERATOR AND METHOD FOR USE OF SAME

TECHNICAL FIELD OF THE INVENTION

This invention relates, in general, to a downhole force generator and, in particular, to a downhole force generator that is anchored at a target location in a well and operably associated with a downhole tool previously positioned in the well then operated to exert a longitudinal or rotary force on the downhole tool.

BACKGROUND OF THE INVENTION

Without limiting the scope of the present invention, its background will be described with reference to using a pulling tool for retrieving a well tool that was previously located within a well, as an example.

After drilling a well that intersects a subterranean hydrocarbon bearing reservoir, a variety of well tools are often positioned in the wellbore during completion, production or remedial activities. For example, temporary packers are often set in the wellbore during the completion and production operating phases of the well. In addition, various operating tools including flow controllers such as plugs, chokes, valves and the like and safety devices such as safety valves are often releasably positioned in the wellbore.

In the event that one of these well tools that has been previously placed within the wellbore requires removal, a pulling tool attached to a conveyance such as a wireline, slickline, coiled tubing or the like is typically run downhole to the location of the well tool to be removed. The pulling tool, which may include a fishing nose and latching assembly, is latched to a fishing neck on the well tool previously placed into the wellbore. Thereafter, the well tool can be dislodged from the wellbore and retrieved to the surface.

It has been found, however, the once a well tool has been positioned within the wellbore, the well tool may become stuck in the wellbore and therefore difficult to retrieve. In addition, even normal retrieval operation may place significant demands on the integrity and strength of the pulling tool and conveyance in wells that are deep, deviated, inclined or horizontal due to elongation of the conveyance and added frictional effects.

Accordingly, prior art pulling tools and conveyances can apply only a limited amount of pull force to dislodge a well tool previously placed into the wellbore. Therefore, a need has arisen for a pulling tool that will provide for the exertion of a greater pulling force such that well tools that are stuck within the wellbore can be retrieved. A need has also arisen for such a pulling tool that will produce the necessary force to retrieve well tools from deep, deviated, inclined or horizontal wellbores.

SUMMARY OF THE INVENTION

The present invention disclosed herein comprises a downhole force generator and a method for using the downhole force generator that are capable of providing sufficient force to dislodge a well tool that is stuck within the wellbore. The downhole force generator of the present invention will also produce the necessary force to retrieve well tools from deep, deviated, inclined or horizontal wellbores. In addition, the downhole force generator of the present invention may be used to actuate well tools from one operational state to another operational state even if the well tool has become stuck in its present operational state.

The downhole force generator of the present invention is adapted to be moved to a target location within a wellbore for interaction with a well tool that was previously positioned within the wellbore. The well tool may be any type of well tool positioned downhole requiring intervention of some type including shifting, actuation, repositioning, retrieval or the like. The well tool may be in a desired or known location downhole or in an undesired or unknown location downhole in the case of certain fishing operations. The downhole force generator includes a downhole power unit having a moveable shaft. An anchor is operably associated with the downhole power unit. The anchor is operable between a radially contracted configuration or running configuration and a radially expanded configuration or anchoring configuration. The anchor is operated between these positions in response to movement of the moveable shaft of the downhole power unit. In the radially expanded configuration, the anchor longitudinally secures the downhole force generator within the wellbore. An operating tool is also operably associated with the downhole power unit. The operating tool operably engages the well tool such as by latching into the well tool, contacting the well tool or being positioned relative to the well tool to enable interaction between the operating tool and the well tool. When the operating tool is operably engaged with the well tool and the anchor is in the anchoring configuration, movement of the moveable shaft will transmit a force to the well tool.

In one embodiment, the downhole power unit includes a self-contained power source for providing electrical power. Additionally, the downhole power unit may include an electric motor including a rotor and a jackscrew assembly including a rotational member connected to the rotor. The rotational member is operably associated with the moveable shaft to impart motion thereto. The moveable shaft of the downhole power unit may be longitudinally moveable such that the downhole force generator generates a longitudinal force on the well tool. Alternatively or additionally, the moveable shaft may be rotatably moveable such that the downhole force generator generates a torsional force on the well tool.

In one embodiment, the anchor of the downhole force generator of the present invention includes barrel slips that mechanically engage the wellbore when the anchor is in the radially expanded configuration. In another embodiment, the anchor includes a packing assembly that sealingly engages the wellbore when the anchor is in the radially expanded configuration. In yet another embodiment, the anchor includes a spring assembly that stores energy when the anchor is in the radially expanded configuration.

In one embodiment, the operating tool of the downhole force generator of the present invention is a shifting tool for actuating the well tool from one operational state to another operational state. In another embodiment, the operating tool is a pulling tool for dislodging the well tool from the wellbore. In this embodiment, the pulling tool may include a latching assembly that engages the well tool and a fishing nose that engages a fishing neck of the well tool.

In another aspect, the present invention is directed to a fishing tool adapted to be moved to a target location within a wellbore for retrieving a well tool previously positioned in the wellbore. The fishing tool includes a downhole power unit having a moveable shaft, an anchor operably associated with the downhole power unit that is operable between a running configuration and an anchoring configuration wherein the anchor longitudinally secures the fishing tool within the wellbore and a pulling tool operably associated with the downhole power unit and operably engageable with the well tool such that when the operating tool is operably engaged with the well tool and the anchor is in the anchoring configuration, movement of the moveable shaft will transmit a force to dislodged the well tool from the wellbore.

In a further aspect, the present invention is directed to a method for transmitting force to a well tool previously positioned in the wellbore. The method includes the steps of running a downhole force generator to a target location downhole, longitudinally securing the downhole force generator within the wellbore, operably engaging the well tool with the downhole force generator and transmitting a force to the well tool with the downhole force generator.

In yet another aspect, the present invention is directed to a method for retrieving a well tool previously positioned in the wellbore. The method includes the steps of running a fishing tool to a target location downhole, longitudinally securing the fishing tool within the wellbore, operably engaging the well tool with the fishing tool and dislodging the well tool from the wellbore by applying a force to the well tool with the fishing tool.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
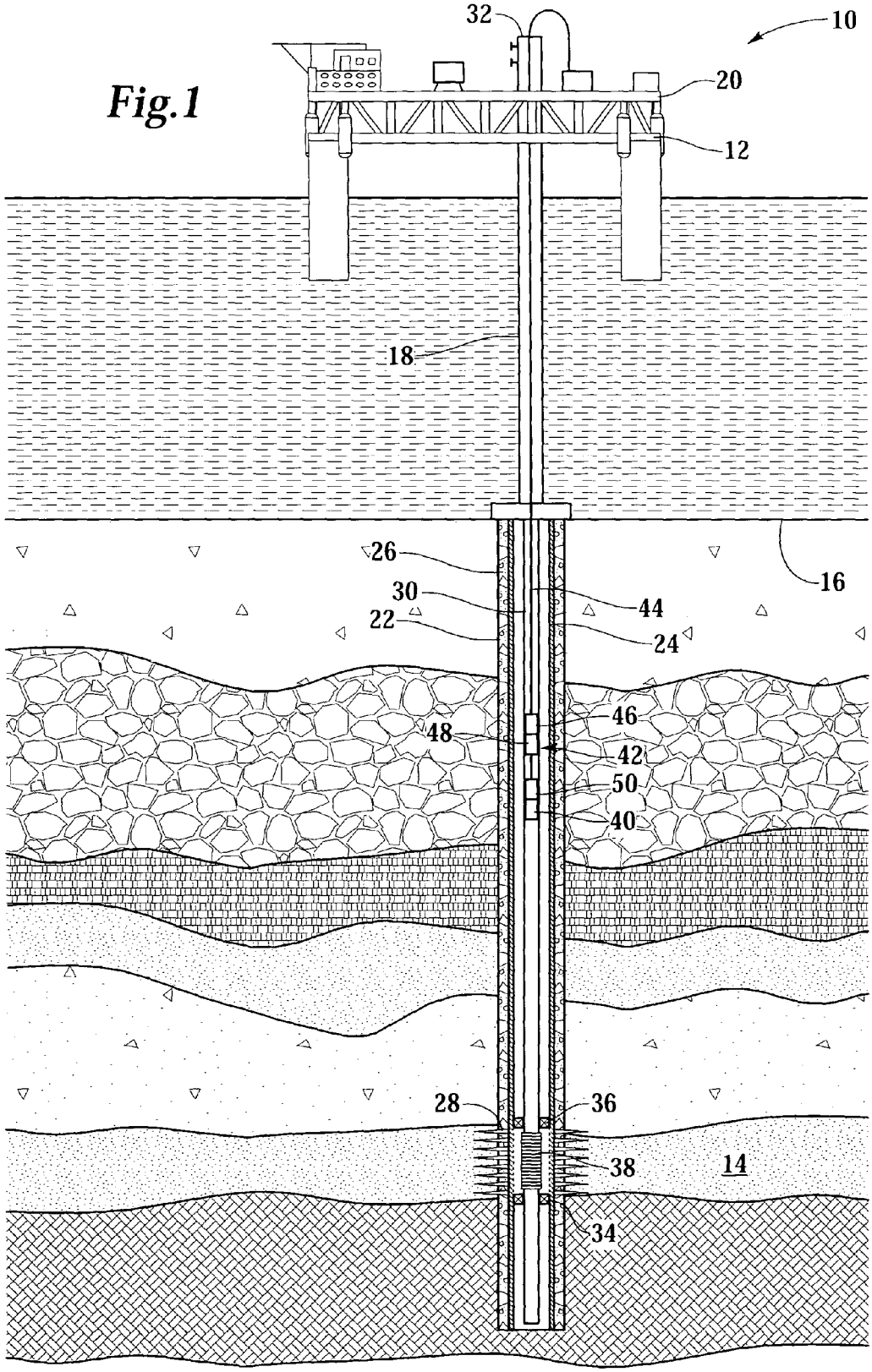
FIG. 1 is a schematic illustration of an offshore oil and gas platform operating a downhole force generator according to the present invention.

Referring initially to FIG. 1, a downhole force generator of the present invention is being operated from an offshore oil and gas platform that is schematically illustrated and generally designated 10. A semi-submersible platform 12 is centered over a submerged oil and gas formation 14 located below sea floor 16. A subsea conductor 18 extends from deck 20 of platform 12 to sea floor 16. A wellbore 22 extends from sea floor 16 and traverse formation 14. Wellbore 22 includes a casing 24 that is cemented therein by cement 26. Casing 24 has perforations 28 in the interval proximate formation 14.

A tubing string 30 extends from wellhead 32 to formation 14 to provide a conduit for production fluids to travel to the surface. A pair of packers 34, 36 provide a fluid seal between tubing string 30 and casing 24 and direct the flow of production fluids from formation 14 through sand control screen 38. Disposed within tubing string 30 is a well tool 40 such as a wireline retrievable subsurface safety valve that is designed to shut in the flow of production fluids if certain out of range conditions occur. In the illustrated embodiment, a fishing operation is being conducted wherein a downhole force generator 42 is being run downhole on a conveyance 44, such as a wireline, a slickline, an electric line, a coiled tubing and a jointed tubing or the like. As explained in greater detail below, downhole force generator 42 includes a downhole power unit 46, an anchor 48 and an operating tool 50. Operating tool 50 may be a pulling tool, a shifting tool or other tool capable of interaction with well tool 40

For example, operating tool 50 may be a shifting tool designed to actuate well tool 40 from one operational state to another operational state. As those skilled in the art will understand, if well tool 40 becomes stuck in one of its operational states, the force required to shift well tool 40 to another of its operational states may be high and may exceed the force which can be applied thereto by conventional wireline shifting tools. Downhole force generator 42 of the present invention, however, can be used to apply the required force to shift well tool 40 from its stuck operational state to its desired operational state. This is achieved by deploying downhole force generator 42 to the target location, anchoring downhole force generator 42 within tubing string 30 with anchor 48, engaging well tool 40 with operating tool 50 and applying a longitudinal or rotational force to well tool 40 with downhole power unit 46, thereby operating well tool 40 from its stuck operational state to its desired operational state.

Similarly, if operating tool 50 is a pulling tool, downhole force generator 42 is capable of providing sufficient force to dislodge well tool 40 from wellbore 22 even if well tool 40 has become stuck within wellbore 22. Specifically, downhole force generator 42 will produce the necessary force to retrieve well tools from deep, deviated, inclined or horizontal wellbores. Accordingly, even though FIG. 1 depicts a vertical well, it should be noted by one skilled in the art that the downhole force generator of the present invention is equally well-suited for use in deviated wells, inclined wells or horizontal wells. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be noted by one skilled in the art that the downhole force generator of the present invention is equally well-suited for use in onshore operations.

Figure 2:
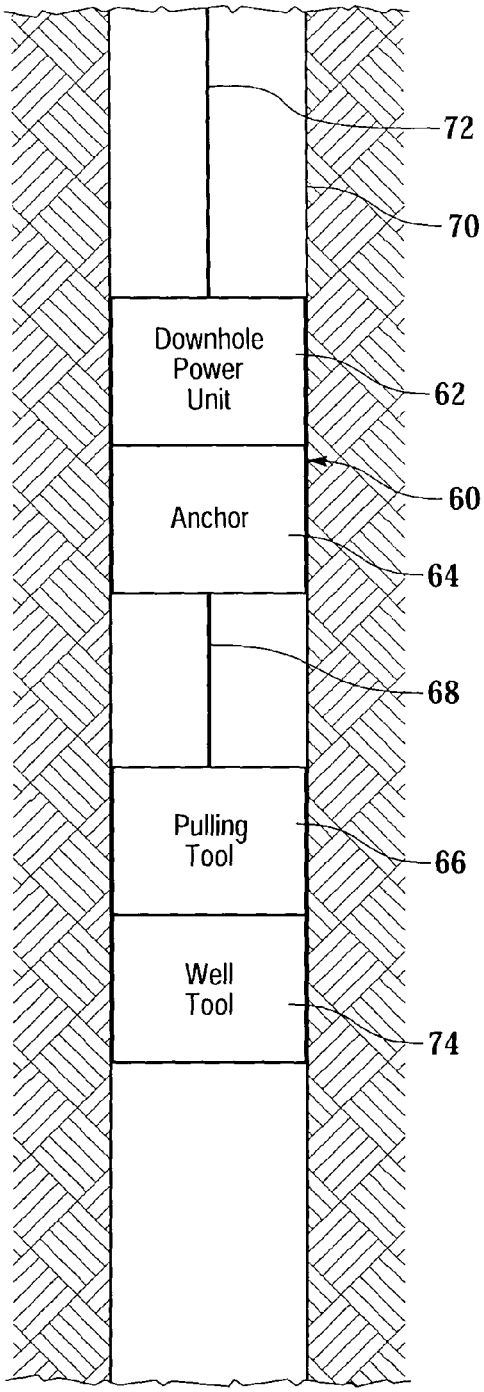
FIG. 2 is a block diagram of a downhole force generator according to the present invention operating to retrieve a well tool that was previously positioned in a wellbore.

Referring now to FIG. 2, therein is schematically depicted a downhole force generator of the present invention that is generally designated 60. Downhole force generator 60 includes a downhole power unit 62, an anchor 64 and a pulling tool 66, each of which will be discussed in greater detail below. Downhole power unit 62 has a moveable member described herein as a moveable shaft 68 that is operably associated with and extends through anchor 64 and that couples to pulling tool 66. Downhole force generator 60 is illustrated as having been lowered into a well 70 on a conveyance 72 such as a wireline, a slickline, coiled tubing, jointed pipe or other tubing string.

In the illustrated embodiment, downhole force generator 60 has reached its target location in well 70 and has engaged a well tool 74. Well tool 74 is not part of the present invention but rather is the workpiece operated upon by the invention. As such, well tool 74 can be any device that has been previously positioned in well 70 or any device that has become a fish within well 70 and is adapted to receive or be engaged by downhole force generator 60. Examples of particular well tools 74 include plugs, locks, chokes, valves and others devices used in any of the various operations of drilling, testing, completing or producing well 70.

Either prior to or after, downhole force generator 60 has engaged well tool 74, downhole force generator 60 is longitudinally secured within well 70 by operating anchor 64. As explained in greater detail below, anchor 64 is operated from its running position to its anchoring position using downhole power unit 62. Specifically, downhole power unit 62 transmits a longitudinal force to anchor 64 via moveable shaft 68 such that anchoring slips engage the inner surface of well 70, thereby longitudinally securing downhole force generator 60 within well 70. Once downhole force generator 60 is longitudinally secured and has engaged well tool 74, operation of moveable shaft 68 of downhole power unit 62 transmits a longitudinal force to well tool 74 such that well tool 74 is dislodged from well 70. After well tool 74 is free, anchor 64 can be released from well 70 such that downhole force generator 60 along with well tool 74 can be retrieved to the surface.

As will be described in more detail below, a particular implementation of downhole power unit 62 includes an elongated housing, a motor disposed in the housing and a sleeve connected to a rotor of the motor. The sleeve is a rotational member that rotates with the rotor. A moveable member such as moveable shaft 68 is received within the threaded interior of the sleeve. Operation of the motor rotates the sleeve which causes the moveable shaft 68 to move longitudinally. Accordingly, when downhole power unit 62 is longitudinally fixed within well 70 and the moveable member is operably associated with well tool 74, a longitudinal force is applied to well tool 74. Alternatively or additionally, the moveable member could operate as a rotational member such that torque is transmitted between downhole power unit 62 and well tool 74.

Preferably, a microcontroller made of suitable electrical components to provide miniaturization and durability within the high pressure, high temperature environments which can be encountered in an oil or gas well is used to control the operation of downhole power unit 62. The microcontroller is preferably housed within the structure of downhole power unit 62, it can, however, be connected outside of downhole power unit 62 but within the tool string moved into well 70. In whatever physical location the microcontroller is disposed, it is operationally connected to downhole power unit 62 to actuate movement of the moveable member when desired. In one embodiment, the microcontroller includes a microprocessor which operates under control of a timing device and a program stored in a memory. The program in the memory includes instructions which cause the microprocessor to control the downhole power unit 62.

The microcontroller operates under power from a power supply which can be at the surface of the well or, preferably, contained within the microcontroller, downhole power unit 62 or otherwise within a downhole portion of the tool string of which these components are a part. For a particular implementation, the power source provides the electrical power to both the motor of downhole power unit 62 and the microcontroller. When downhole power unit 62 is at the target location, the microcontroller commences operation of downhole power unit 62 as programmed. For example, with regard to controlling the motor that operates the sleeve receiving the moveable member, the microcontroller sends a command to energize the motor to rotate the sleeve in the desired direction to either extend or retract the moveable member at the desired speed. One or more sensors monitor the operation of downhole power unit 62 and provide responsive signals to the microcontroller. When the microcontroller determines that a desired result has been obtained, it stops operation of downhole power unit 62, such as by de-energizing the motor of the exemplified implementation.

Figure 3:
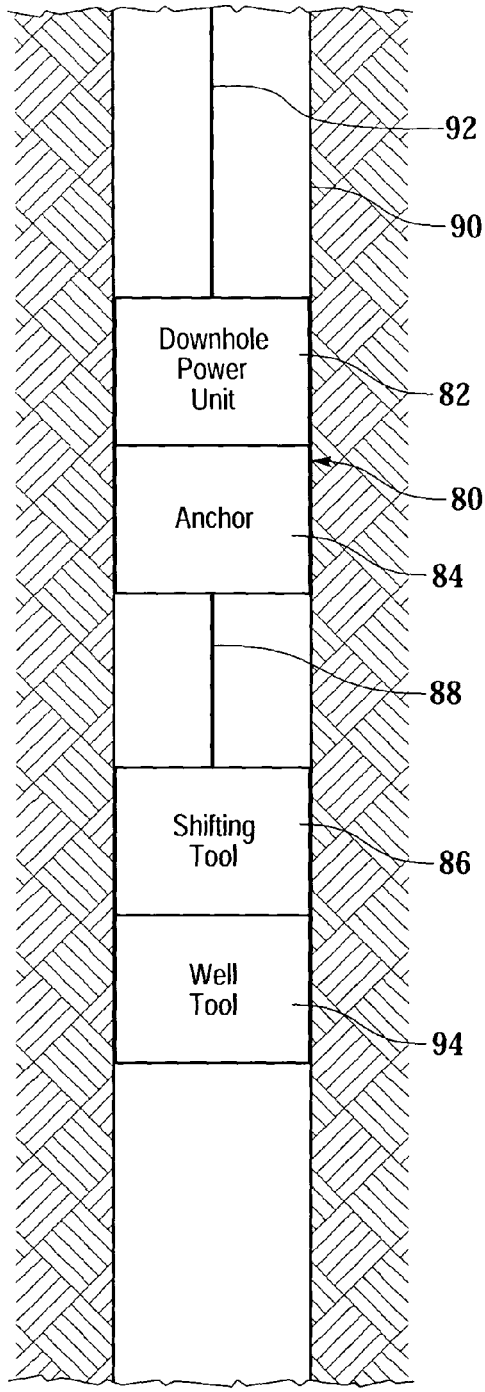
FIG. 3 is a block diagram of a downhole force generator according to the present invention operating to actuate a well tool positioned in a wellbore.

Referring now to FIG. 3, therein is schematically depicted another embodiment of a downhole force generator of the present invention that is generally designated 80. Downhole force generator 80 includes a downhole power unit 82, an anchor 84 and a shifting tool 86. Downhole power unit 82 has a moveable member described herein as a moveable shaft 88 that is operably associated with and extends through anchor 84 and that couples to shifting tool 86. Downhole force generator 80 is illustrated as having been lowered into a well 90 on a conveyance 92. In the illustrated embodiment, downhole force generator 80 has reached its target location in well 90 and has engaged a well tool 94. As stated above, the well tool is not part of the present invention but rather is the workpiece operated upon by the invention. In the illustrated embodiment, well tool 94 it can be any device that is positioned in well 90 that may be actuated from one operating position to another by translational or rotational motion. Examples of particular well tools 94 include chokes, valves, sliding sleeves and the like used in any of the various operations of drilling, testing, completing or producing well 90.

Either prior to or after, downhole force generator 80 has engaged well tool 94, downhole force generator 80 is longitudinally secured within well 90 by operating anchor 84. Once downhole force generator 80 is longitudinally secured and has engaged well tool 94, operation of moveable shaft 88 of downhole power unit 82 transmits a longitudinal or rotational force to well tool 94 such that well tool 94 is actuated from one operating position to another. After well tool 94 is actuated, anchor 84 can be released from well 90 such that downhole force generator 80 can be retrieved to the surface.

Figure 4:
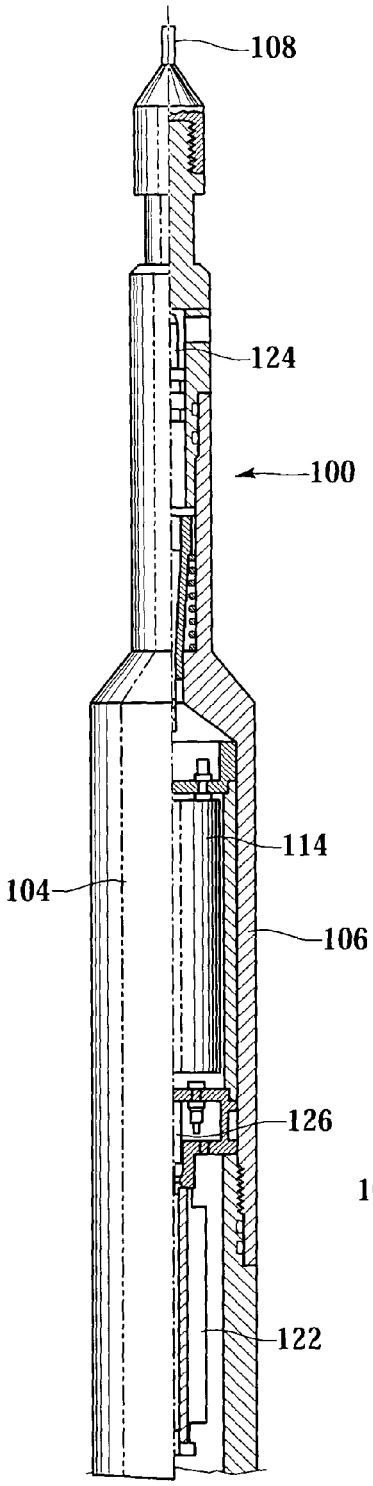
FIGS. 4–6 are quarter sectional views of successive axial sections of one embodiment of a downhole power unit of a downhole force generator according to the present invention.
Figure 5:
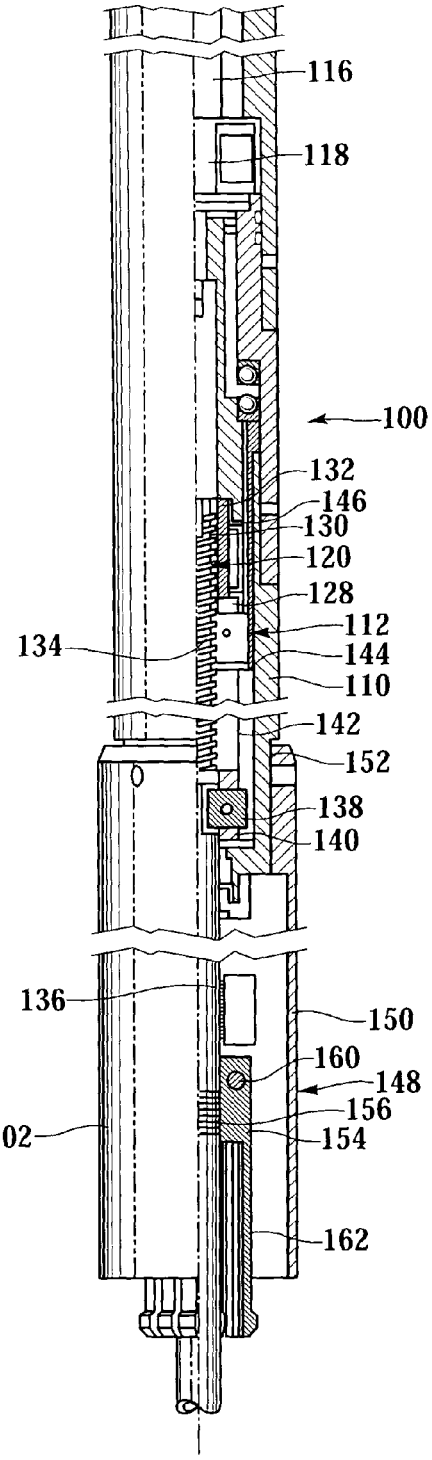
Figure 6:
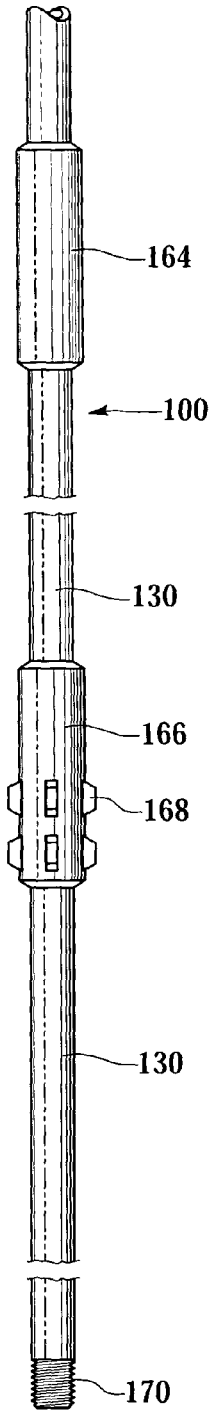

Referring next to FIGS. 4–6, therein is depicted successive axial sections of an exemplary downhole power unit that is generally designated 100 and that is capable of operations in the downhole force generator of the present invention. Downhole power unit 100 includes a working assembly 102 and a power assembly 104. Power assembly 104 includes a housing assembly 106 which comprises suitably shaped and connected generally tubular housing members. An upper portion of housing assembly 106 includes an appropriate mechanism to facilitate coupling of housing 106 to a conveyance 108. Housing assembly 106 also includes a clutch housing 110 as will be described in more detail below, which forms a portion of a clutch assembly 112.

In the illustrated embodiment, power assembly 104 includes a self-contained power source, eliminating the need for power to be supplied from an exterior source, such as a source at the surface. A preferred power source comprises a battery assembly 114 which may include a pack of twenty to sixty alkaline or lithium batteries.

Connected with power assembly 104 is the force generating and transmitting assembly. The force generating and transmitting assembly of this implementation includes a direct current (DC) electric motor 116, coupled through a gearbox 118, to a jackscrew assembly 120. A plurality of activation mechanisms 122, 124 and 126, as will be described, can be electrically coupled between battery assembly 114 and electric motor 116. Electric motor 116 may be of any suitable type. One example is a motor operating at 7500 revolutions per minute (rpm) in unloaded condition, and operating at approximately 5000 rpm in a loaded condition, and having a horsepower rating of approximately 1/30th of a horsepower. In this implementation, motor 116 is coupled through the gearbox 118 which provides approximately 5000:1 gear reduction. Gearbox 118 is coupled through a conventional drive assembly 128 to jackscrew assembly 120.

The jackscrew assembly 120 includes a threaded shaft 130 which moves longitudinally, rotates or both, in response to rotation of a sleeve assembly 132. Threaded shaft 130 includes a threaded portion 134, and a generally smooth, polished lower extension 136. Threaded shaft 130 further includes a pair of generally diametrically opposed keys 138 that cooperate with a clutch block 140 which is coupled to threaded shaft 130.

Clutch housing 110 includes a pair of diametrically opposed keyways 142 which extend along at least a portion of the possible length of travel. Keys 138 extend radially outwardly from threaded shaft 130 through clutch block 140 to engage each of keyways 142 in clutch housing 110, thereby selectively preventing rotation of threaded shaft 130 relative to housing 110.

Rotation of sleeve assembly 132 in one direction causes threaded shaft 130 and clutch block 140 to move longitudinally upwardly relative to housing assembly 110 if shaft 130 is not at its uppermost limit. Rotation of the sleeve assembly 132 in the opposite direction moves shaft 130 downwardly relative to housing 110 if shaft 130 is not at its lowermost position. Above a certain level within clutch housing 110, as indicated generally at 144, clutch housing 110 includes a relatively enlarged internal diameter bore 146 such that moving clutch block 140 above level 144 removes the outwardly extending key 138 from being restricted from rotational movement. Accordingly, continuing rotation of sleeve assembly 132 causes longitudinal movement of threaded shaft 130 until clutch block 140 rises above level 144, at which point rotation of sleeve assembly 132 will result in free rotation of threaded shaft 130. By virtue of this, clutch assembly 112 serves as a safety device to prevent burn-out of the electric motor, and also serves as a stroke limiter. In a similar manner, clutch assembly 112 may allow threaded shaft 130 to rotation freely during certain points in the longitudinal travel of threaded shaft 130.

In the illustrated embodiment, downhole power unit 100 incorporates three discrete activation assemblies, separate from or part of the microcontroller discussed above. The activation assemblies enable jackscrew 120 to operate upon the occurrence of one or more predetermined conditions. One depicted activation assembly is timing circuitry 122 of a type known in the art. Timing circuitry 122 is adapted to provide a signal to the microcontroller after passage of a predetermined amount of time. Further, downhole power unit 100 can include an activation assembly including a pressure-sensitive switch 124 of a type generally known in the art which will provide a control signal once the switch 124 reaches a depth at which it encounters a predetermined amount of hydrostatic pressure within the tubing string. Still further, downhole power unit 100 can include an motion sensor 126, such as an accelerometer or a geophone that is sensitive to vertical motion of downhole power unit 100. Accelerometer 126 can be combined with timing circuitry 122 such that when motion is detected by accelerometer 126, timing circuitry 122 is reset. If so configured, the activation assembly operates to provide a control signal after accelerometer 126 detects that downhole power unit 100 has remained substantially motionless within the well for a predetermined amount of time.

Working assembly 102 includes an actuation assembly 148 which is coupled through housing assembly 106 to be movable therewith. Actuation assembly 148 includes an outer sleeve member 150 which is threadably coupled at 152 to housing assembly 106. Working assembly 102 also includes a connecting sub 154 which is releasably coupled at threaded connection 156 to a portion of polished extension 136 of threaded shaft 130 which allows for the disconnection of threaded shaft 130 from connecting sub 154 upon application of a predetermined axial force. Connecting sub 154 facilitates connecting downhole power unit 100 to an anchor as will be described below. Specifically, connecting sub 154 is coupled to the anchor through pins 160 and collet member 162.

Threaded shaft 130 includes a radially enlarged region 164 that interacts with collet member 162 when it is desired to release the anchor from the well as will be described below. Threaded shaft 130 also includes a radially enlarged region 166 having locating keys 168 that interacts with the anchor when it is desired to release the anchor from the well as will be described below. The lower end 170 of threaded shaft 130 has a threaded coupling that allows for the coupling of downhole power unit 100 to an operating tool such as a pulling tool as will be described below or a shifting tool.

Even though a particular embodiment of a downhole power unit has been depicted and described, it should be clearly understood by those skilled in the art that other types of downhole power devices could alternatively be used with the downhole force generator of the present invention such that the downhole force generator of the present invention may exert a force on a well tool positioned within the wellbore.

Figure 7:
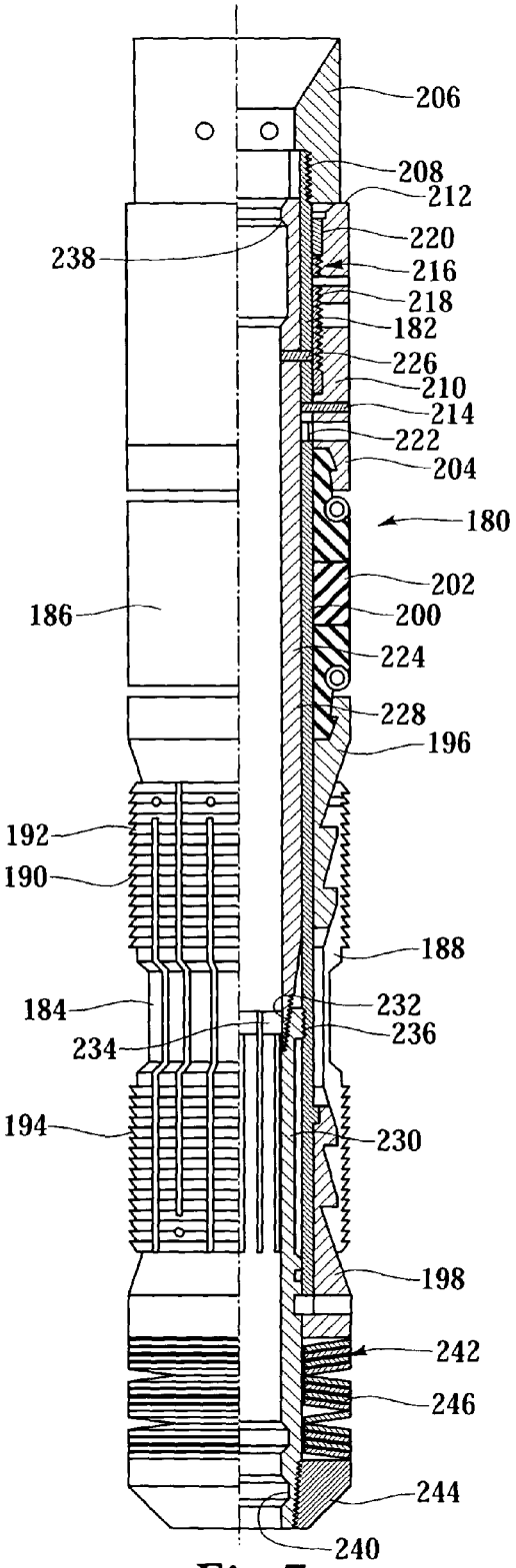
FIG. 7 is a quarter sectional view of one embodiment of an anchor of a downhole force generator according to the present invention.

Referring now to FIG. 7, therein is shown an exemplary anchor that is generally designated 180 and that is capable of operations in the downhole force generator of the present invention. It should be noted that threaded shaft 130 of downhole power unit 100 passes through a cental bore of anchor 180 as will be described in greater detail below. Anchor 180 has a support mandrel assembly 182, which supports a barrel slip assembly 184. Barrel slip assembly 184 is operable between a reduced diameter condition by which anchor 180 may be placed into or removed from a tubular string and an expanded diameter condition by which barrel slip assembly 184 is set and mechanically engages the tubular string such that the force generating tool of the present invention is longitudinally secured within the tubular string. In the illustrated embodiment, anchor 180 also includes a packing assembly 186 which is also movable between a relatively reduced diameter condition, and a relatively expanded diameter condition whereby packing assembly 186 sealingly engages the interior of the tubular string.

Barrel slip assembly 184 preferably includes a one-piece slip body 188 which surrounds a portion of anchor 180 in a circumferentially continuous manner, such that slip body 188 is unbroken at any point around the anchor 180. Slip body 188 comprises a plurality of anchoring slips 190 which are configured to be radially expansible. Each anchoring slip 190 is preferably provided with opposing sets of anchoring teeth 192, 194 upon longitudinally opposed portions of its exterior surface which are adapted to mechanically engage the interior surface of a tubular string when barrel slip assembly 184 is set. Opposed anchoring teeth 192, 194 are each directional to resist axial movement of anchor 180, within the tubular string in either axial direction.

Barrel slip assembly 184 further includes an actuation assembly which includes upper and lower annular wedge assemblies 196, 198 which are adapted to be longitudinally movable relative to each other along an outer mandrel 200. Slip body 188 is configured to engage and cooperate with wedge assemblies 196, 198 in such a manner that converging longitudinal movement of annular wedge assemblies 196, 198 causes radial expansion of slip body 188 by urging anchoring slips 190 radially outwardly.

Annular packing assembly 186 has a substantially elastomeric sleeve 202 which is also operable between an expanded diameter condition and a reduced diameter condition by virtue of axial compression. Annular packing assembly 186 is concentrically disposed relative to outer mandrel 200 of support mandrel assembly 182, and is disposed at a relatively uphole position relative to barrel slip assembly 184. Compressional force may be applied to elastomeric sleeve 202 between annular wedge assembly 196 and retaining member 204.

Outer mandrel 200 of anchor 180 extends through barrel slip assembly 184 and packing assembly 186 in a generally coaxial relation therewith. A generally annular engagement member 206 is attached by a threaded coupling 208, or other attachment mechanism, to outer mandrel 200 proximate the upper end thereof. Engagement member 206 is adapted to be coupled the downhole power unit 100 described above via its connecting sub 154 and specifically, through pins 160 and collet member 162 of connecting sub 154 of downhole power unit 100.

The actuation assembly of anchor 180 includes an axial compression member 210 that is disposed around an upper portion of outer mandrel 200. Axial compression member 210 defines a radially extending actuation surface 212 which engages outer sleeve member 150 of actuation assembly 148 downhole power unit 100. One or more shear pins 214 are provided to resist motion of compression member 210 with respect to mandrel 200. A motion restricting assembly 216 is operatively coupled to axial compression member 210 to allow movement of axial compression member 210 in only a downward direction relative to outer mandrel 200. In the illustrated embodiment, motion restriction assembly 216 includes a threaded ring 218 and a split-ring 220 which associate axial compression member 210 with outer mandrel 200.

Split ring 220 is adapted to be movable axially along mandrel 200 during setting of anchor 180 and will engage recess 222 of outer mandrel 200 during removal operations. Engagement of split ring 220 with annular recess 222 provides a positive lock of compression member 210 relative to outer mandrel 200.

Anchor 180 further includes a release mandrel assembly 224 disposed within outer mandrel 200 in a generally coaxial relation therewith. One or more shear pins 226 may be placed through portions of release mandrel assembly 224 and outer mandrel 200 to resist axial displacement between the mandrels. Release mandrel assembly 224 is axially extensible in response to diverging axial tension applied proximate its axial ends. In a preferred embodiment, release mandrel 224 includes an upper section 228 and a lower section 230, which are coupled to one another by a selectively releasable connection, such as a threaded connection 232. Releasable threaded connection 232 is configured to release under diverging axial tension of a generally predetermined magnitude applied across upper section 228 and lower section 230 of release mandrel assembly 224, such that the sections separate and become axially spaced from each other. In this preferred embodiment, releasable threaded connection 232 is formed through use of a plurality of threaded collet fingers 234 in lower section 230 of release mandrel assembly 224. Other extensible designs for release mandrel 224 may, of course be contemplated, such as shearable telescoping configurations.

A threaded connection 236 may also be provided between collet fingers 234 on lower half 230 of release mandrel assembly 224 and outer mandrel 200. Threaded connection 236 is adapted to maintain a fixed relation between lower section 230 and outer mandrel 200 when upper and lower sections 228, 230 are engaged. Threaded connection 236 will also be severable under divergent axial tension as upper and lower sections 228, 230 are separated.

Upper releasable mandrel section 228 includes an internal generally annularly extending actuation surface 238 proximate its upper end. Similarly, lower releasable mandrel section 230 includes an internal, generally annular, actuation surface 240. Annular actuation surfaces 238, 240 on upper and lower releasable mandrel sections 228, 230 facilitate engagement with a downhole power unit 100, by providing surfaces for receiving the application of divergent axial tension across releasable mandrel 224 assembly to cause the releasing of threaded connections 232, 236.

Anchor 180 further includes a spring assembly 242, which includes one or more springs disposed around lower section 230 of release mandrel 224. The lower end of spring assembly 242 is secured to the release mandrel 224 by a retaining ring 244 which is preferably threadably coupled to lower section 230. Springs 246 are adapted to store energy resulting from the axial compression of portions of anchor 180 when anchor 180 is set. Telescoping of compression member 210 relative to outer mandrel 200, will cause radial expansion of elastomeric sleeve 202, setting of barrel slip assembly 184 and compression of springs 246.

Even though a particular embodiment of an anchor has been depicted and described, it should be clearly understood by those skilled in the art that other types of anchoring devices could alternatively be used for longitudinally securing the downhole force generator of the present invention within a wellbore such that the downhole force generator of the present invention may exert a force on a well tool positioned within the wellbore.

Figure 8:
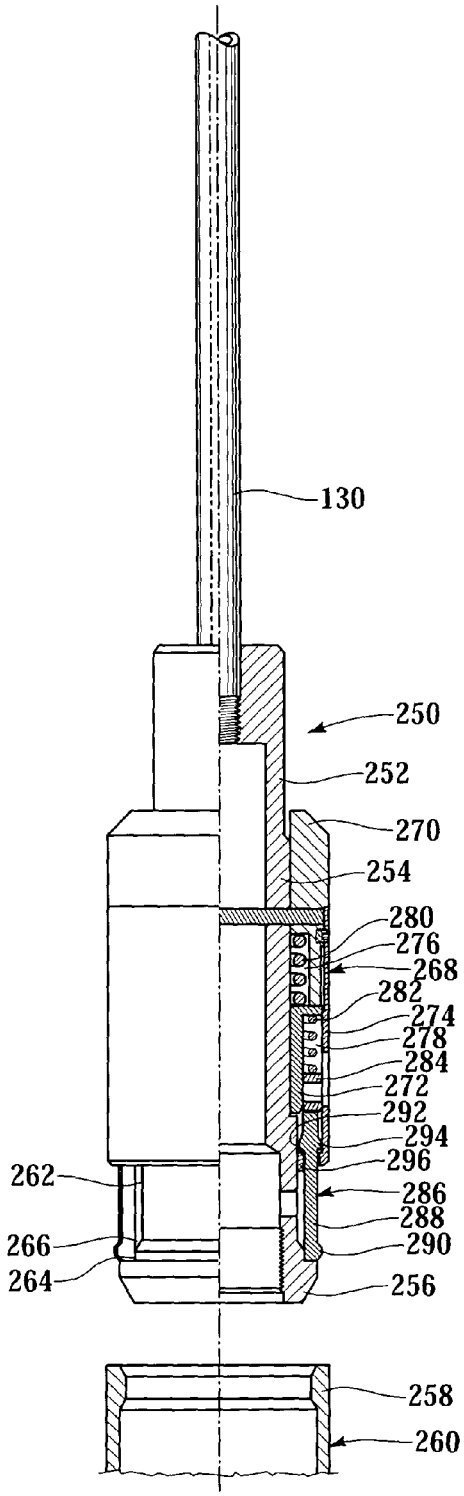
FIG. 8 is a quarter sectional view of one embodiment of a pulling tool of a downhole force generator according to the present invention.

Referring now to FIG. 8, therein is depicted an exemplary pulling tool that is generally designated 250 and that is capable of operations in the downhole force generator of the present invention. Pulling tool 250 is depicted as being coupled to the end of threaded shaft 130 of downhole power unit 100. Pulling tool 250 has a latching mandrel 252 that includes a reduced diameter portion 254 and a beveled fishing nose 256 for facilitating its engagement with a fishing neck 258 of a well tool 260 at the target location. The latching mandrel 252 further includes a reduced diameter portion 262 and an increased diameter portion 264 having a ramp portion 266 therebetween. The increased diameter portion 264 is positioned adjacent fishing nose 256 of the latching mandrel 252.

A tubular housing 268 is disposed over latching mandrel 252. Housing 268 includes an upper housing member 270, a lower housing member 272 and an outer housing member 274. Housing 268 also has two internal bores 276, 278. A compression spring 280 is disposed in internal bore 276 between upper housing member 270 and lower housing member 272 to urge upper housing member 270 in a direction away from lower housing member 272. A compression spring 282 and a retaining ring 284 are disposed in internal bore 278. Compression spring 282 is disposed between a shoulder of lower housing member 272 and retaining ring 284 to urge upper retaining ring 284 in a direction toward fishing nose 256 of the latching mandrel 252.

Pulling tool 250 includes a latching assembly 286 for automatically latching mandrel 252 of pulling tool 250 to fishing neck 258 of well tool 260 when fishing nose 256 of pulling tool 250 engages fishing neck 258. The portion of latching assembly 286 which provides the capability of latching pulling tool 250 to fishing neck 258 includes a plurality of latching members 288 which are spaced around the outer surface of latching mandrel 252. Latching members 288 are slidably positioned on latching mandrel 252 and extend in a direction parallel to the axis of pulling tool 250. Each of the latching members 288 has an enlarged end portion 290 which normally engages increased diameter portion 264 of latching mandrel 252. The ends of latching members 288 opposite the enlarged end portions 290 contact retaining ring 284. Each of the latching members 288 includes an enlarged inner portion 292 and an enlarged outer portion 294. Enlarged inner portion 292 includes a ramp portion and a shoulder that contacts a stop 296 when latching members 288 are urged to their lowermost position by compression spring 282. Enlarged outer portion 294 forms an external shoulder that is positioned within outer housing 274.

Even though a particular embodiment of a pulling tool has been depicted and described, it should be clearly understood by those skilled in the art that other types of pulling tools, such a spears, overshots and the like could alternatively be used with the downhole force generator of the present invention such that the downhole force generator of the present invention may be couple to and exert a force on a well tool positioned within the wellbore.

An exemplary deployment and retrieval of the downhole force generator of the present invention will now be described with reference to FIG. 4–8, collectively. If it becomes necessary to retrieve a well tool that was previously positioned in a wellbore, the downhole force generator of the present invention is run downhole on a conveyance to the target location. As will be understood by those skilled in the art, depending upon the specifics of the operation to be performed by the downhole force generator of the present invention, the downhole force generator may be anchored within the wellbore then operably coupled to the well tool or, as describe below, operably coupled to the well tool then anchored within the wellbore.

Once the downhole force generator of the present invention is at the target location, pulling tool 250 is operably engaged with well tool 260. Specifically, fishing nose 256 of latching mandrel 252 engages fishing neck 258 of well tool 260. As fishing nose 256 moves into fishing neck 258, the ramp portions of enlarged end portions 290 of latching members 288 first engage complimentary ramp portions within fishing neck 258 such that latching members 288 and retaining ring 284 are pushed against spring 282. Spring 282 is compressed which allows latching members 288 to be moved away from fishing nose 256 whereby enlarged end portions 290 of latching members 288 are moved from increased radius portion 264 of latching mandrel 252 up ramp portion 266 and onto reduced radius portion 262. This allows enlarged end portions 290 of latching members 288 to move past the enlarged inwardly extending complimentary portion of fishing neck 258 to a position within fishing neck 258. Once enlarged end portions 290 of latching members 288 pass the enlarged inwardly extending portion of fishing neck 258, spring 282 moves retaining ring 284 and latching members 288 in the opposite direction such that enlarged end portions 290 of latching members 288 are moved back to their outward engaging position whereby latching members 288 are resting on surface 264 of latching mandrel 252. Once pulling tool 250 has operably engaged well tool 260, longitudinal movement of pulling tool 250 will be transmitted to well tool 260.

Continuing with the exemplary deployment, once pulling tool 250 has operably engaged well tool 260, the downhole force generator of the present invention is anchored with the wellbore. As described above, downhole power unit 100 is adapted to cooperate with anchor 180. Specifically, prior to run in, engagement member 206 of anchor 180 is coupled with connecting sub 154 of downhole power unit 100 through pins 160. In addition, collet member 162 of connecting sub 154 of downhole power unit 100 is positioned adjacent to annular actuation surface 238 on upper releasable mandrel sections 228. In this configuration, longitudinal movement of threaded shaft 130 of downhole power unit 100 moves packing assembly 186 and barrel slip assembly 184 from their reduced diameter conditions to their expanded diameter conditions by engagement of outer sleeve 150 of downhole power unit 100 with axial compression member 210 of anchor 180. This longitudinal movement exerts an axial force upon compression member 210 due to the downward axial movement of outer member 150 with respect to anchor 180. Accordingly, as will be appreciated from the above discussion, actuation of motor 116 by activation assemblies 122, 124, 126, and the resulting longitudinal movement of threaded screw 134 will cause a relative downward movement of outer sleeve 150 relative to anchor 180. This relative downward movement will shear shear pins 214 securing compression member 210 in an initial, unactuated, position relative to support mandrel assembly 182 and will thereby cause the previously described radial expansion of elastomeric sleeve 202, setting of barrel slip assembly 184 and compression of springs 246. Once anchor 180 is in this set configuration, the downhole force generator of the present invention is anchored and longitudinally secured within the wellbore.

Once the downhole force generator of the present invention is anchored within the wellbore, continued longitudinal movement of threaded shaft 130 of downhole power unit 100 transmits a longitudinal force on well tool 260 via pulling tool 250. Specifically, continued longitudinal movement of threaded shaft 130 severs the threaded connection between threaded shaft 130 and connecting sub 154. As threaded shaft 130 continues longitudinal movement, the force applied to well tool 260 increases until well tool 260 is dislodged from the wellbore.

Once well tool 260 has been dislodged, the downhole force generator of the present invention and well tool 260 may be retrieved to the surface. Specifically, downhole power unit 100 is operated to continue the longitudinal movement of threaded shaft 130 until locating keys 168 that are cooperatively positioned within radially enlarged region 166 engage with annular actuation surface 240 on lower releasable mandrel sections 230 of anchor 180. At the same time, radially enlarged region 164 engages collet member 162 of connecting sub 154 of downhole power unit 100 such that collet member 162 becomes engaged with annular actuation surface 238 on upper releasable mandrel sections 228.

Once downhole power unit 100 and anchor 180 are positioned as described, the operation of downhole power unit 100 to longitudinally move of threaded shaft 130 is reversed such that threaded shaft 130 is longitudinally moved in the opposite direction. This longitudinal movement creates an axial load across release mandrel 224 between annular actuation surfaces 238, 240. Continued longitudinal movement will exert a sufficient axial tensile force to separate upper releasable mandrel section 228 from lower releasable mandrel section 230 at threaded connections 232, 236. Upon extension of release mandrel 224, compression energy stored in spring assembly 242 is released and anchor 180 is returned to its reduced diameter configuration. Once anchor 180 is in the reduced diameter configuration, the downhole force generator of the present invention and well tool 260 may be retrieved to the surface.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole force generator adapted to be moved to a target location within a wellbore for interaction with a well tool positioned in the wellbore, the downhole force generator comprising:

a downhole power unit having a moveable shaft, an electric motor including a rotor, and a jackscrew assembly including a rotational member connected to the rotor, the rotational member operably associated with the moveable shaft to impart motion thereto;

an anchor operably associated with the downhole power unit, the anchor operable between a running configuration and an anchoring configuration wherein the anchor longitudinally secures the downhole force generator within the wellbore; and an operating tool operably associated with the downhole power unit and operably engageable with the well tool such that when the operating tool is operably engaged with the well tool and the anchor is in the anchoring configuration, movement of the moveable shaft will transmit a force to the well tool.

2. The downhole force generator as recited in claim 1 wherein the downhole power unit further comprises a self-contained power source for providing electrical power.

3. The downhole force generator as recited in claim 1 wherein the downhole power unit further comprises a controller that controls the operation of the moveable shaft.

4. The downhole force generator as recited in claim 1 wherein the running configuration of the anchor is a radially contracted configuration, wherein the anchoring configuration of the anchor is a radially expanded configuration and wherein the anchor is operated therebetween in response to movement of the moveable shaft.

5. The downhole force generator as recited in claim 1 wherein the moveable shaft of the downhole power unit is longitudinally moveable such that the downhole force generator generates a longitudinal force on the well tool.

6. The downhole force generator as recited in claim 1 wherein the moveable shaft of the downhole power unit is rotatably moveable such that the downhole force generator generates a rotary force on the well tool.

7. The dowuhole force generator as recited in claim 1 wherein the anchor further comprises slips that mechanically engage the wellbore in the radially expanded configuration of the anchor.

8. The downhole force generator as recited in claim 1 wherein the anchor further comprises a packing assembly that substantially sealingly engages the wellbore in the radially expanded configuration of the anchor.

9. The downhole force generator as recited in claim 1 wherein the anchor further comprises a spring assembly that stores energy when the anchor is in the radially expanded configuration.

10. The downhole force generator as recited in claim 1 wherein the moveable shaft of the downhole power unit extends through a longitudinal bore of the anchor to the operating tool.

11. The downhole force generator as recited in claim 1 wherein the operating tool further comprises a shifting tool for actuating the well tool from one operational state to another operational state.

12. The downhole force generator as recited in claim 1 wherein the operating tool further comprises a pulling tool for dislodging the well tool.

13. The downhole force generator as recited in claim 12 wherein the pulling tool further comprises a latching assembly that engages the well tool.

14. The downhole force generator as recited in claim 12 wherein the pulling tool further comprises a fishing nose that engages a fishing neck of the well tool.

15. A fishing tool adapted to be moved to a target location within a wellbore for dislodging a well tool positioned in the wellbore, the fishing tool comprising:

a downhole power unit having a moveable shaft, an electric motor including a rotor, and a jackscrew assembly including a rotational member connected to the rotor, the rotational member operably associated with the moveable shaft to impart motion thereto;

an anchor operably associated with the downhole power unit, the anchor operable between a running configuration and an anchoring configuration wherein the anchor longitudinally secures the downhole force generator within the wellbore; and a pulling tool operably associated with the downhole power unit and operably engageable with the well tool such that when the pulling tool is operably engaged with the well tool and the anchor is in the anchoring configuration, movement of the moveable shaft will transmit a force to dislodge the well tool.

16. The fishing tool as recited in claim 15 wherein the downhole power unit further comprises a self-contained power source for providing electrical power.

17. The fishing tool as recited in claim 15 wherein the downhole power unit further comprises a controller that controls the operation of the moveable shaft.

18. The fishing tool as recited in claim 15 wherein the running configuration of the anchor is a radially contracted configuration, wherein the anchoring configuration of the anchor is a radially expanded configuration and wherein the anchor is operated therebetween in response to movement of the moveable shaft.

19. The fishing tool as recited in claim 15 wherein the moveable shaft of the downhole power unit is longitudinally moveable such that the fishing tool generates a longitudinal force on the well tool.

20. The fishing tool as recited in claim 15 wherein the moveable shaft of the downhole power unit is rotatably moveable such that the fishing tool generates a rotary force on the well tool.

21. The fishing tool as recited in claim 15 wherein the anchor further comprises slips that mechanically engage the wellbore in the radially expanded configuration of the anchor.

22. The fishing tool as recited in claim 15 wherein the anchor further comprises a packing assembly that substantially sealingly engages the wellbore in the radially expanded configuration of the anchor.

23. The fishing tool as recited in claim 15 wherein the anchor further comprises a spring assembly that stores energy when the anchor is in the radially expanded configuration.

24. The fishing tool as recited in claim 15 wherein the moveable shaft of the downhole power unit extends through a longitudinal bore of the anchor to the pulling tool.

25. A method for transmitting force to a well tool positioned in the wellbore, the method comprising the steps of:

running a downhole force generator including a downhole power unit having a moveable shaft, an anchor and an operating tool to a target location downhole;

longitudinally securing the downhole force generator within the wellbore by operating the anchor from a radially contracted configuration to a radially expanded configuration in response to movement of the moveable shaft;

operably engaging the well tool with the operating tool; and transmitting a force to the well tool with the operating tool in response to movement of the moveable shaft.

26. The method as recited in claim 21 wherein the step of running a downhole force generator to a target location downhole further comprises running the downhole force generator to a target location downhole on a conveyance.

27. The method as recited in claim 26 wherein the step of running the downhole force generator to a target location downhole on a conveyance further comprises the step of selecting the conveyance from the group consisting of a wireline, a slickline, an electric line, a coiled tubing and a jointed tubing.

28. The method as recited in claim 25 wherein the step of operating an anchor between a radially contracted configuration and a radially expanded configuration further comprises mechanically engaging slips with the wellbore.

29. The method as recited in claim 25 wherein the step of operating an anchor between a radially contracted configuration and a radially expanded configuration further comprises substantially sealingly engaging a packing assembly with the wellbore.

30. The method as recited in claim 25 wherein the step of operably engaging the well tool with the downhole force generator further comprises operably engaging the well tool with a pulling tool.

31. The method as recited in claim 25 wherein the step of operably engaging the well tool with the downhole force generator further comprises operably engaging the well tool with a shifting tool.

32. The method as recited in claim 25 wherein the step of transmitting a force to the well tool with the downhole force generator further comprises transmitting a longitudinal force to the well tool.

33. The method as recited in claim 25 wherein the step of transmitting a force to the well tool with the downhole force generator further comprises transmitting a rotary force to the well tool.

34. The method as recited in claim 25 wherein the step of transmitting a force to the well tool with the downhole force generator further comprises actuating the well tool from one operational state to another operational state.

35. The method as recited in claim 25 wherein the step of transmitting a force to the well tool with the downhole force generator further comprises dislodging the well tool.

36. The method as recited in claim 25 wherein the step of longitudinally securing the downhole force generator within the wellbore occurs prior to the step of operably engaging the well tool with the downhole force generator.

37. The method as recited in claim 25 wherein the step of longitudinally securing the downhole force generator within the wellbore occurs after the step of operably engaging the well tool with the downhole force generator.

38. A method for dislodging a well tool positioned in the wellbore, the method comprising the steps of:

running a fishing tool including a downhole power unit having a moveable shaft, an anchor and an operating tool to a target location downhole;

longitudinally securing the fishing tool within the wellbore by operating the anchor from a radially contracted configuration to a radially expanded configuration in response to movement of the moveable shaft;

operably engaging the well tool with the operating tool; and dislodging the well tool by applying a force to the well tool with the operating tool in response to movement of the moveable shaft.

39. The method as recited in claim 38 wherein the step of running a fishing tool to a target location downhole further comprises running the fishing tool to a target location downhole on a conveyance.

40. The method as recited in claim 39 wherein the step of running the fishing tool to a target location downhole on a conveyance further comprises the step of selecting the conveyance from the group consisting of a wireline, a slickline, an electric line, a coiled tubing and a jointed tubing.

41. The method as recited in claim 38 wherein the step of operating an anchor between a radially contracted configuration and a radially expanded configuration further comprises mechanically engaging slips with the wellbore.

42. The method as recited in claim 38 wherein the step of operating an anchor between a radially contracted configuration and a radially expanded configuration further comprises substantially sealingly engaging a packing assembly with the wellbore.

43. The method as recited in claim 38 wherein the step of dislodging the well tool from the wellbore further comprises transmitting a longitudinal force to the well tool.

44. The method as recited in claim 38 wherein the step of dislodging the well tool from the wellbore further comprises transmitting a rotary force to the well tool.

45. The method as recited in claim 38 wherein the step of longitudinally securing the fishing tool within the wellbore occurs after the step of operably engaging the well tool with the fishing tool.

46. The method as recited in claim 38 wherein the step of longitudinally securing the fishing tool within the wellbore occurs prior to the step of operably engaging the well tool with the fishing tool.

47. A downhole force generator adapted to be moved to a target location within a wellbore for interaction with a well tool positioned in the wellbore, the downhole force generator comprising:

a downhole power unit having a moveable shaft;

an anchor operably associated with the downhole power unit, the anchor operable between a running configuration and an anchoring configuration in response to movement of the moveable shaft, in the anchoring configuration, the anchor longitudinally securing the downhole force generator within the wellbore, the moveable shaft of the downhole power unit extending through a longitudinal bore of the anchor; and an operating tool operably associated with the moveable shaft of the downhole power unit and operably engageable with the well tool such that when the operating tool is operably engaged with the well tool and the anchor is in the anchoring configuration, movement of the moveable shaft will transmit a force to the well tool via the operating tool.

48. The downhole force generator as recited in claim 47 wherein the downhole power unit further comprises a self-contained power source for providing electrical power.

49. The downhole force generator as recited in claim 47 wherein the downhole power unit further comprises:

an electric motor including a rotor; and a jackscrew assembly including a rotational member connected to the rotor, the rotational member operably associated with the moveable shaft to impart motion thereto.

50. The downhole force generator as recited in claim 47 wherein the downhole power unit further comprises a controller that controls the operation of the moveable shaft.

51. The downhole force generator as recited in claim 47 wherein the moveable shaft of the downhole power unit is longitudinally moveable such that the downhole force generator generates a longitudinal force on the well tool.

52. The downhole force generator as recited in claim 47 wherein the moveable shaft of the downhole power unit is rotatably moveable such that the downhole force generator generates a rotary force on the well tool.

53. The downhole force generator as recited in claim 47 wherein the anchor further comprises slips that mechanically engage the wellbore in the radially expanded configuration of the anchor.

54. The downhole force generator as recited in claim 47 wherein the anchor further comprises a packing assembly that substantially sealingly engages the wellbore in the radially expanded configuration of the anchor.

55. The downhole force generator as recited in claim 47 wherein the anchor further comprises a spring assembly that stores energy when the anchor is in the radially expanded configuration.

56. The downhole force generator as recited in claim 47 wherein the operating tool further comprises a shifting tool for actuating the well tool from one operational state to another operational state.

57. The downhole force generator as recited in claim 47 wherein the operating tool further comprises a pulling tool for dislodging the well tool.

58. The downhole force generator as recited in claim 57 wherein the pulling tool further comprises a latching assembly that engages the well tool.

59. The downhole force generator as recited in claim 57 wherein the pulling tool further comprises a fishing nose that engages a fishing neck of the well tool.

* * * * *